US005799918A

United States Patent [19]

Swinderman et al.

[11] Patent Number: 5,799,918

[45] Date of Patent: Sep. 1, 1998

[54] VIBRATOR MOUNTING ARRANGEMENT

[75] Inventors: R. Todd Swinderman, Kewanee, Ill.; Mike Lindbeck, Livonia, Mich.; Doug Lindstrom, Kewanee, Ill.

[73] Assignee: Martin Engineering Company, Neponset, Ill.

[21] Appl. No.: 853,384

[22] Filed: May 8, 1997

Related U.S. Application Data

[63] Continuation of Ser. No. 436,930, May 8, 1995, abandoned.

[51] Int. Cl.[6] ..... A47H 1/10

[52] U.S. Cl. ..... 248/300; 248/219.1

[58] Field of Search ..... 119/57.91, 57.92, 119/51.11, 57.1; 248/300, 205.1, 205.3, 218.4, 219.1, 279.1, 284.1, 286.1, 292.14, 219.4, 230.1; 222/200; 366/108, 110, 111, 114

[56] References Cited

U.S. PATENT DOCUMENTS

| | | | |
|---|---|---|---|
| 1,979,548 | 11/1934 | Horsch | 259/72 |
| 2,914,829 | 12/1959 | Willemain | 248/279.1 |
| 2,995,347 | 8/1961 | Rich | 259/72 |
| 3,764,116 | 10/1973 | Fuller et al. | 259/72 |
| 4,781,348 | 11/1988 | Cutforth et al. | 248/219.1 |
| 4,936,550 | 6/1990 | Wickham et al. | 248/219.1 |
| 5,052,651 | 10/1991 | Guddee | 248/552 |
| 5,076,079 | 12/1991 | Monoson et al. | 70/58 |
| 5,188,443 | 2/1993 | Lowell et al. | 248/284.1 |
| 5,335,892 | 8/1994 | Busch | 248/551 |
| 5,507,464 | 4/1996 | Hamerski et al. | 248/205.3 |

*Primary Examiner*—Ramon O. Ramirez
*Assistant Examiner*—Willie Berry, Jr.
*Attorney, Agent, or Firm*—Lee, Mann, Smith, McWilliams, Sweeney & Ohlson

[57] ABSTRACT

A vibrator mounting arrangement for attaching a vibrator to an object having one of a plurality of different mounting surface configurations. The mounting arrangement includes a mounting base adapted to receive the vibrator. The mounting base includes first and second downwardly extending curved lips. A first leg having a first foot member and a first curved flange is attached to the first lip. The first flange includes a plurality of slots which allow the first leg to be pivotally rotated to position the first foot member at various different angles as desired. A second leg is attached to the second lip of the mounting base. The second leg includes a second foot member and a curved flange which includes a plurality of slots. The slots of the second flange permit the second foot member to be pivotally rotated to position the second foot member at various different angles as desired. Each foot member may include an adhesive material to adhesively secure the vibrator mounting arrangement to the mounting surface of the object to be vibrated.

18 Claims, 2 Drawing Sheets

VIBRATOR MOUNTING ARRANGEMENT

This application is a continuation, of application Ser. No. 08/436,930, filed May 8, 1995, now abandoned.

BACKGROUND OF THE INVENTION

The present invention is directed to a vibrator mounting arrangement which is adapted to attach a vibrator to an object to be vibrated and, in particular, to a vibrator mounting arrangement which is adapted to be attached to an object having one of a plurality of different surface configurations.

Vibrators are typically attached to silos, hoppers, chutes, pipes, machinery and other objects and structures to facilitate the flow of material therethrough. The surface to which a vibrator is mounted may have various different configurations such as a planar surface, a circularly or cylindrically curved surface, or a conically curved surface. Not only does the mounting surface configuration to which a vibrator is attached vary, between the planar, cylindrical and conical surfaces, but the cylindrical and conical mounting surfaces also may vary in configuration due to differences in the diameter or radius of the curve which forms the mounting surface and differences in the slopes of the conical mounting surfaces.

In addition, the mounting surface of an object may be made of various different materials such as steel, stainless steel or non-metallic materials such as plastic or fiberglass. It is often impractical or impossible to drill holes through the mounting surface to permit the attachment of a vibrator to a mounting surface with fasteners. While a mounting arrangement can be welded to a steel mounting surface, there are situations wherein the arc from the welding process may pose a potential hazard making welding infeasible. In addition, welding to stainless steel is difficult and is not feasible with non-metallic materials. There is also often a need to temporarily mount a vibrator to an object until it is feasible to permanently mount the vibrator at a later time. The present invention provides a universal vibrator mounting arrangement for quickly and easily attaching a vibrator to the surface of an object which may be configured in various different shapes.

SUMMARY OF THE INVENTION

A vibrator mounting arrangement is provided for attaching a vibrator to the surface of an object which may be configured in various different manners including planar surfaces and various types of curved surfaces. The mounting arrangement include s a mounting base adapted to receive the vibrator for attachment thereto. The mounting base includes a first curved lip and a second curved lip. The first and second curved lips may extend generally parallel to one another or may be set at an angle to one another in the gen erally V-shaped arrangement. A first leg is adjustably attached to the first lip and a second leg is adjustably attached to the second lip. The first leg includes a first foot member which is adapted to be attached to the mounting surface of the object and a first curved flange having a plurality of elongate slots. The first curved flange is attached to the first lip by fasteners which extend through the slots. The slots of the first curved flange provide selective pivotal movement of the first foot member with respect to the mounting base.

A second leg is attached to the second lip of the mounting base. The second leg includes a second foot member which is adapted to be attached to the mounting surface and a second curved flange including a plurality of elongate slots.

The second flange is attached to the second lip by fasteners which extend through the slots. The slots of the second curved flange provide selective pivotal movement of the second foot member with respect to the mounting base. The first and second foot members may be pivoted from a position wherein the foot members are generally co-planar to various different angular orientations relative to one another such that the feet may be attached to objects having planar mounting surfaces or curved mounting surfaces having curvatures of various different radii. An adhesive material is attached to the first foot member and also to the second foot member such that the vibrator mounting arrangement may be adhesively attached to the mounting surface of the object to be vibrated.

DESCRIPTION OF THE PREFERRED EMBODIMENTS

Figure 1:
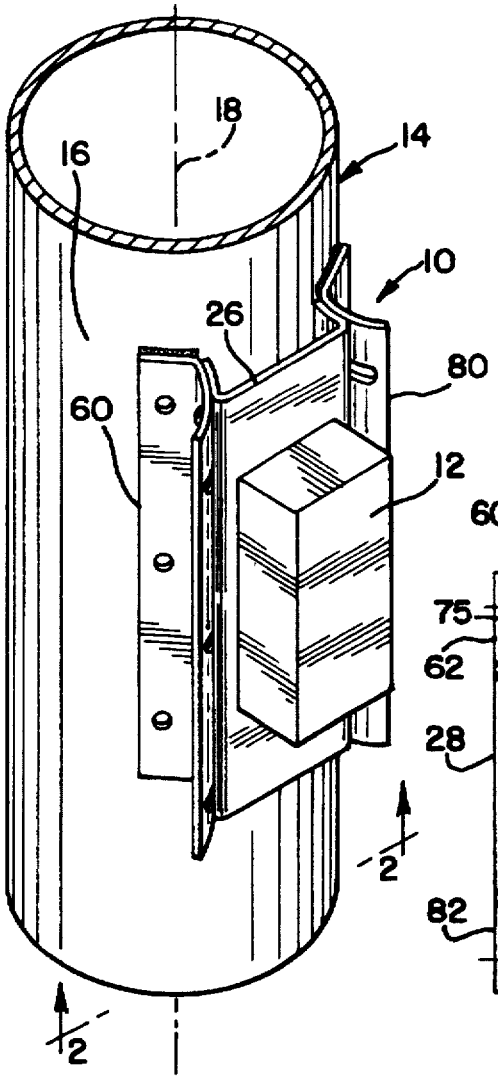
FIG. 1 is a perspective view of the vibrator mounting arrangement shown mounting a vibrator to an object having a cylindrical mounting surface.
Figure 2:
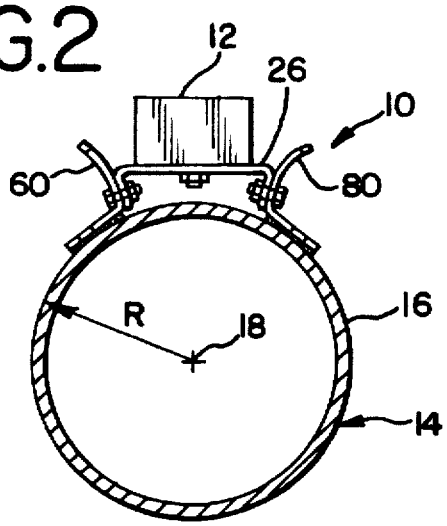
FIG. 2 is an end view of the vibrator mounting arrangement taken along lines 2—2 of FIG. 1.

A vibrator mounting arrangement 10 of the present invention is shown in FIGS. 1 and 2 mounting a vibrator 12 to a structure or object 14 to be vibrated having a generally circularly or cylindrically curved mounting surface 16. The object 14 includes a central longitudinal axis 18. The mounting surface 16 is curved in a circular or cylindrical shape having a radius R extending from the longitudinal axis 18 to the mounting surface 16. The vibrator 12 may be one of various different well known types of vibrators, such as nonimpacting vibrators, and may be electrically or pneumatically operated. One the of vibrator 12 that may be advantageously used with the mounting arrangement 10 is a Findeva FP vibrator distributed by Martin Engineering Company, applicant herein. The object 14 may be a silo, tank, hopper, pipe or any other structure.

Figure 3:
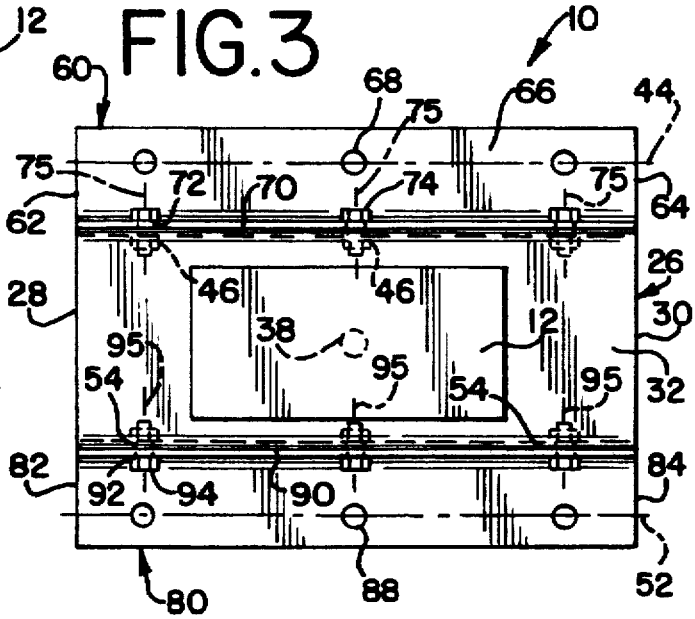
FIG. 3 is a top plan view of the vibrator mounting arrangement shown with a vibrator attached thereto.
Figure 4:
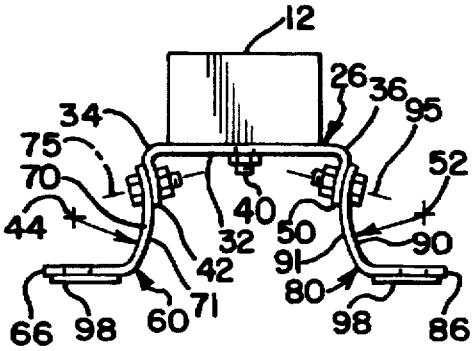
FIG. 4 is an end view of the vibrator mounting arrangement with a vibrator attached thereto.
Figure 5:
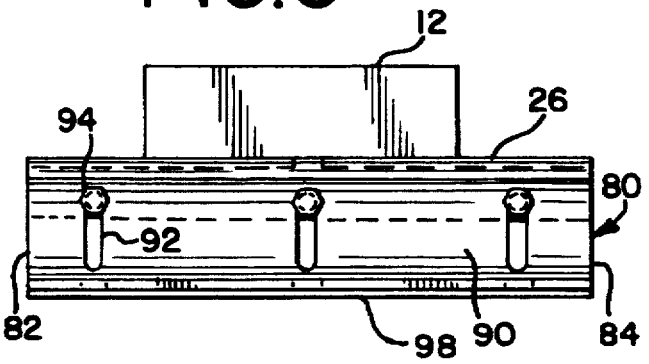
FIG. 5 is a side elevational view of the vibrator mounting arrangement with a vibrator attached thereto.

As best shown in FIGS. 3 and 4, the mounting arrangement 10 includes a mounting base 26 having a first end 28 and a second end 30. The mounting base 26 includes a generally rectangular and planar platform 32. The platform 32 includes an aperture 38 which is adapted to receive a fastener 40 for removably fastening the vibrator 12 to the platform 32. The platform 32 may include additional apertures in various arrangements to accommodate the attachment of the vibrator 12 to the platform 32. The platform 32 includes a first generally linear edge 34 and a spaced apart and generally parallel linear edge 36. The mounting base 26 also includes a lip 42 which extends downwardly from and along the first edge 34 of the platform 32 between the first end 28 and second end 30 of the mounting base 26. The lip 42 is curved along its length in the shape of a circular arc extending about a longitudinal axis 44 which extends generally parallel to the first edge 34 of the platform 32. If desired the lip 42 could be generally planar. The lip 42 includes a plurality of spaced apart apertures 46.

A lip 50 extends downwardly from and along the second edge 36 of the platform 32 between the first end 28 and the second end 30 of the mounting base 26. The lip 50 is curved along its length in the shape of a circular arc extending about a longitudinal axis 52 which extends generally parallel to the second edge 36 of the platform 32 and the longitudinal axis 44. The lip 50 includes a plurality of apertures 54 which are spaced along the length of the lip 50.

A leg 60 having a first end 62 and a second end 64 is adjustably attached to the outside surface of the lip 42 of the mounting base 26. The leg 60 includes a generally rectangular and planar foot member 66 which extends between the first end 62 and the second end 64 of the leg 60. The foot member 66 may include a plurality of apertures 68. The leg 60 also includes a curved flange 70 which is rigidly attached to the foot member 66. The flange 70 is curved along its length in the shape of an arc of a circle formed about the longitudinal axis 44 such that the inner surface 71 of the flange 70 has approximately the same radius of curvature as the outside surface of the lip 42 and conforms to the curvature of the lip 42. The flange 70 includes a plurality of spaced apart elongated slots 72. The slots 72 are elongated in a direction which is generally perpendicular to the longitudinal length of the flange 70. The slots 72 of the flange 70 are aligned in registration with the apertures 46 in the lip 42 of the mounting base 26. The leg 60 is adjustably attached to the mounting base 26 by fasteners 74, such as nuts and bolts, which extend through the slots 72 and apertures 46. Each fastener 74 has a longitudinal axis 75 as illustrated in FIG. 4. When the fasteners 74 are loosened, the fasteners 74 are slidable within the slots 72 between the opposing ends of the slots such that the leg 60 and foot member 66 may be pivoted or rotated about the longitudinal axis 44 to selectively provide various different angular orientations of the foot member 66 as desired. The slots 72 are slightly wider than the diameter of the fasteners 74 extending therethrough such that the foot member 66 may be rotated or pivoted a short distance about an axis which is substantially parallel to the axes 75 of the fasteners 74. The flange 70 and the lip 42 are preferably made of relatively thin and flexible metal, such as eleven gauge stainless steel, such that any resulting misalignment between the curvature of the flange 70 with the lip 42 can be accommodated by the flexing of the flange 70 and/or the lip 42. When the fasteners 74 are tightened, the foot member 66 is selectively rigidly retained in the desired orientation.

The mounting arrangement 10 also includes a leg 80 which extends between a first end 82 and a second end 84 which is constructed substantially identically to the leg 60. The leg 80 is adjustably attached to the outside surface of the lip 50 of the mounting base 26. The leg 80 includes a generally rectangular and planar foot member 86 which extends between the first end 82 and the second end 84 of the leg 80. The foot member 86 may include one or more apertures 88. The leg 80 also includes a curved flange 90 which is rigidly attached to the foot member 86. The flange 90 is curved along its length in the shape of an arc of a circle formed about the longitudinal axis 52 such that the inner surface 91 of the flange 90 has approximately the same radius of curvature as the outside surface of the lip 50. The flange 90 includes a plurality of spaced apart elongated slots 92. The slots 92 are elongated in a direction which is generally perpendicular to the longitudinal length of the flange 90. The slots 72 are aligned in registration with the apertures 54 in the lip 50 of the mounting base 26. The flange 90 is adjustably attached to the lip 50 with fasteners 94, such as nuts and bolts, which extend through the slots 92 and apertures 54. Each fastener 94 has a longitudinal axis 95 as shown in FIG. 4. When the fasteners 94 are loosened, the fasteners 94 are slidable within the slots 92 between the opposing ends of the slots such that the leg 80 and foot member 86 may be rotated or pivoted about the longitudinal axis 52 to selectively provide various different angular orientations of the foot member 86 as desired. The slots 92 are slightly wider than the diameter of the fasteners 94 extending therethrough such that the foot member 86 may be rotated or pivoted a short distance about an axis which is substantially parallel to the axes 95 of the fasteners 94. The flange 90 and the lip 50 are preferably made of relatively thin and flexible metal, such as eleven gauge stainless steel, such that any resulting misalignment between the curvature of the flange 90 with the lip 50 can be accommodated by the flexing of the flange 90 and/or the lip 50. When the fasteners 94 are tightened, the foot member 86 is selectively rigidly retained in the desired orientation.

An adhesive material 98, such as a double-sided adhesive pad, may be adhesively secured to the bottom surface of the foot members 66 and 86. The adhesive material 98 may include a peelably removable cover strip (not shown) to prevent premature adherence of the adhesive material 98 to any other objects. The adhesive material 98 may be one of various different types of adhesives which are well known such as a double coated foam tape as supplied by 3M.

In operation, the vibrator 12 is attached to the platform 32 of the mounting base 26. Alternatively, the vibrator 12 may be attached to the mounting arrangement 10 after the mounting arrangement 10 has been attached to the object 14. The fasteners 74 and 94 are initially loosened such that the leg 60 may be pivoted about the longitudinal axis 44, with the fasteners 74 sliding within the slots 72, and such that the leg 80 may be pivoted about the longitudinal axis 52, with the fasteners 94 sliding within the slots 92. The mounting arrangement 10 may then be placed adjacent to the mounting surface 16 of the object 14. The legs 60 and 80 may then be selectively pivoted to orient the feet 66 and 86 to respective angular positions wherein the feet 66 and 86 have the greatest surface contact with the mounting surface 16, generally the positions where the feet 66 and 86 are substantially tangential to the mounting surface 16. The fasteners 74 and 94 are then tightened to retain the feet 66 and 86 in the desired orientation. The protective cover strips (not shown) may then be removed from the adhesive material 98. The mounting arrangement 10 is then pressed against the mounting surface 16 such that the adhesive material 98 secures the feet 66 and 86, and thereby the mounting arrangement 10, to the mounting surface 16. If desired, and where conditions permit, the mounting arrangement 10 may be attached to the mounting surface 16 with fasteners extending through the apertures 68 and 88 which are located in the feet 66 and 86.

As shown in FIG. 4, the feet 66 and 86 of the mounting arrangement 10 may be oriented generally co-planar to one another such that the mounting arrangement 10 may be attached to a generally planar mounting surface. As shown in FIG. 2, the mounting arrangement 10, through the pivoting of the feet 66 and 86 to various different angular orientations relative to one another, may be attached to a circularly or cylindrically curved mounting surface 16 of substantially any radius R which is generally convex. The mounting arrangement 10 may also be attached to concavely curved surfaces by increasing the length of the flanges 70 and 90 and the slots 72 and 92 from that shown in FIG. 4.

Figure 6:
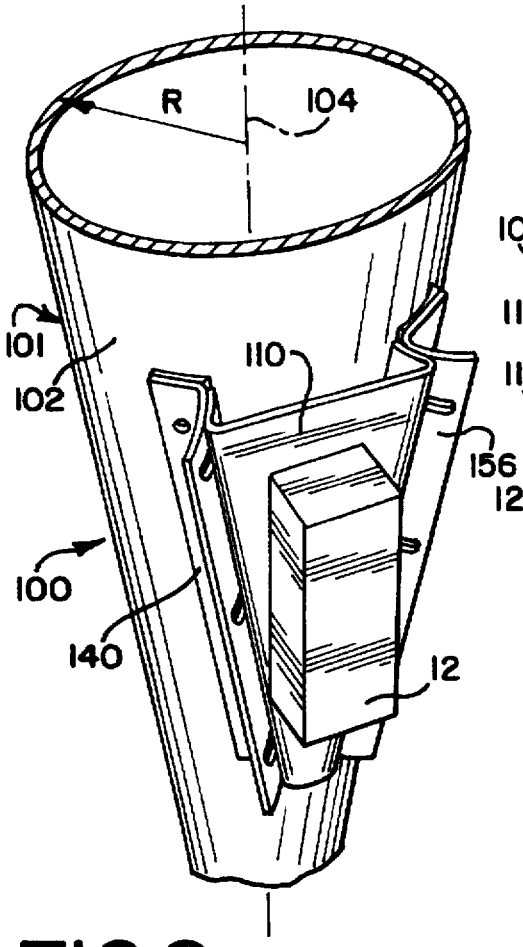
FIG. 6 is a perspective view of a modified embodiment of the vibrator mounting arrangement shown mounting a vibrator to an object having a generally conical mounting surface.

A modified embodiment of the vibrator mounting arrangement is shown in FIGS. 6–9 and is identified with the reference numeral 100. As shown in FIG. 6, the mounting arrangement 100 is particularly adapted to attach the vibrator 12 to an object 101 having curved mounting surface 102 which is generally conical in shape. The object 101 includes a central longitudinal axis 104 such that the mounting surface is located at a radius R from the longitudinal axis 104. The length of the radius R varies along the length of the longitudinal axis 104.

Figure 7:
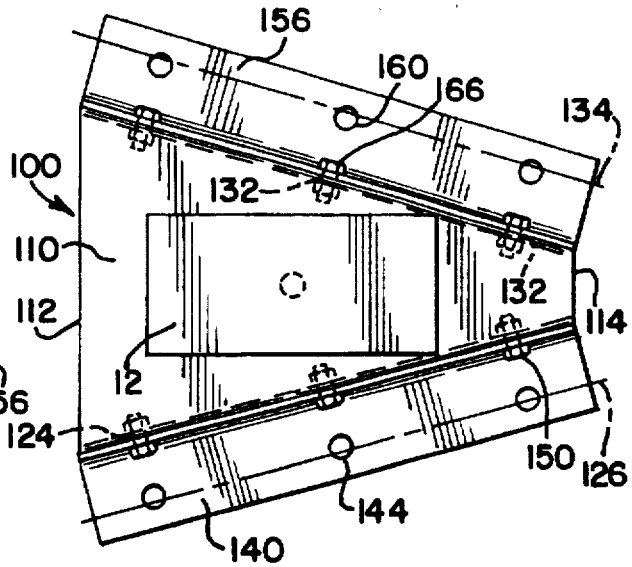
FIG. 7 is a top plan view of the modified vibrator mounting arrangement shown in FIG. 6 with a vibrator attached thereto.

As best shown in FIG. 7, the mounting arrangement 100 includes a mounting base 110 having a first end 112 and a second end 114. The mounting base 110 includes a platform 116 which is generally triangular and planar. The platform 116 includes a first edge 118 and a second edge 120. The first edge 118 and the second edge 120 are oriented at an angle to one another in a generally V-shaped arrangement. The mounting base 110 includes a lip 122 which extends downwardly from and along the first edge 118 of the platform 116. The lip 122 includes a plurality of spaced apart apertures 124 and is concavely curved along its length in the shape of a circular arc formed about a longitudinal axis 126. The mounting base 110 also includes a lip 130 which extends downwardly from and along the second edge 120 of the platform 116. The lip 130 includes a plurality of spaced apart apertures 132. The lip 130 is concavely curved along its length in the shape of a circular arc formed about a longitudinal axis 134.

The mounting arrangement 100 also includes a leg 140 which is constructed substantially identical to the legs 60 and 80 of the mounting arrangement 10. The leg 140 includes a foot member 142 having a plurality of spaced apart apertures 144 and a curved flange 146 having a plurality of elongated slots 148. The flange 146 is concavely curved along its length in the shape of a circular arc formed about the longitudinal axis 126. The flange 146 is adjustably attached to the lip 122 by fasteners 150 which extend through the slots 148 and apertures 124. The flange 146 and foot member 142 are thereby selectively rotatable or pivotal about the longitudinal axis 126 such that the foot member 142 may be oriented in various different angular positions as desired. The foot member 142 may also be slightly pivoted about an axis which is generally transverse to the axis 126.

The mounting arrangement 100 also includes a leg 156 which is constructed substantially identically to the legs 60 and 80 of the mounting arrangement 10. The leg 156 includes a foot member 158 having a plurality of apertures 160. The leg 156 also includes a curved flange 162 having a plurality of elongate slots 164. The flange 162 is curved along its length in the shape of a circular arc extending about the longitudinal axis 134. The flange 162 is adjustably attached to the lip 130 by fasteners 166 which extend through the slots 164 and the apertures 132. The leg 156 and the foot member 158 are rotatable or pivotal about the axis 134 such that the foot member 158 may be orientated in various angular positions as desired. The foot member 158 may also be slightly pivoted about an axis which is generally transverse to the axis 134. An adhesive material 170 may be attached to the lower surface of the foot members 142 and 158.

Figure 8:
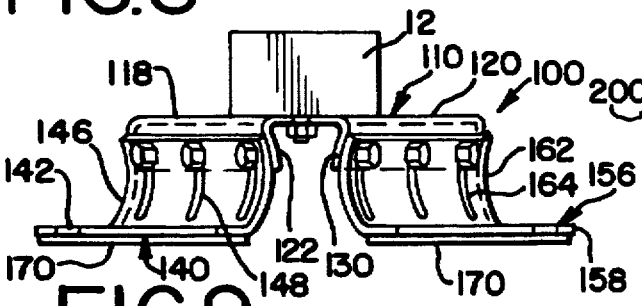
FIG. 8 is an end view of the modified vibrator mounting arrangement with a vibrator attached thereto.
Figure 9:
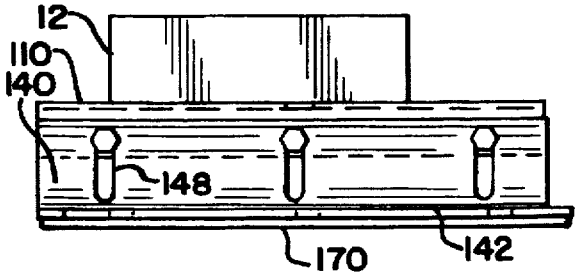
FIG. 9 is a side elevational view of the modified vibrator mounting arrangement with a vibrator attached thereto.

The feet 142 and 158 of the mounting arrangement 100 are pivotal about respective axes 126 and 134 which are disposed at an angle to one another in a generally V-shaped arrangement as best shown in FIG. 7. The mounting arrangement 100 is thereby particularly well suited for attaching a vibrator 12 to a curved mounting surface 102 which is generally conical. The shape of the platform 116 of the mounting arrangement 100 may be varied as desired to orient the rotational axes 126 and 134, and the feet 142 and 158, at various different angles relative to each other as desired. As best shown in FIG. 8, the mounting arrangement 100 may also be mounted to a generally planar mounting surface.

Figure 10:
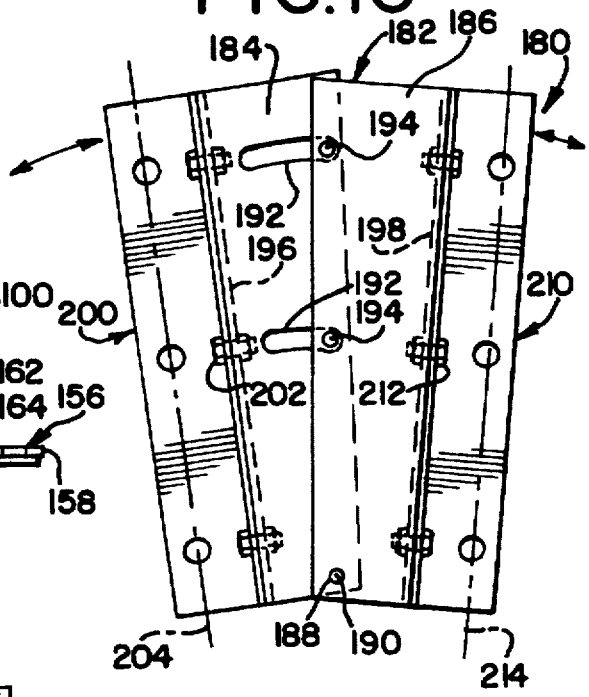
FIG. 10 is a top plan view of another modified embodiment of the vibrator mounting arrangement.

Another modified embodiment of the vibrator mounting arrangement is shown in FIG. 10 and is designated with the reference numeral 180. The mounting arrangement 180 includes a mounting base 182. The mounting base 182 includes a first platform 184 and a second platform 186. The platform 184 is pivotally attached to the platform 186 by a fastener 188, such as a rivet or bolt and nut. The platforms 184 and 186 are pivotal with respect to one another about an axis 190 which extends longitudinally through the fastener 188. The platform 184 includes a plurality of curved slots 192 which are curved along an arc of a circle which extends about the axis 190. Fasteners 194 extend through circular apertures in the second platform 186 and through the curved slots 192. The fasteners 194 are selectively slidable within the curved slots 192 between the opposite ends thereof. The first platform 184 may include only one curved slot 192 or additional curved slots 192 as desired. The second platform 186 may also include curved slots rather than the circular apertures through which the fasteners 194 extend.

The first platform 184 includes a curved lip 196 and the second platform 186 includes a curved lip 198. A first leg 200, which is constructed substantially identically to the leg 60, is adjustably attached to the curved lip 196 with fasteners 202. The leg 200 is selectively rotatable or pivotal about a longitudinal axis 204. A second leg 210, which is constructed substantially identically to the leg 80, is adjustably attached to the curved lip 198 with fasteners 212. The leg 210 is selectively rotatable or pivotal about a longitudinal axis 214.

When the fasteners 194 are loosened, the first platform 184 and second platform 186 may be selectively pivoted about the axis 190 relative to one another such that the axes 204 and 214 may selectively be oriented generally parallel to one another, for mounting to planar or cylindrically curved mounting surfaces, or at various different angles relative to one another as desired for mounting to planar or conically curved mounting surfaces. Once the platforms 184 and 186 are oriented in the desired position, the fasteners 194 are then tightened to retain the platforms 184 and 186 in the desired position. The legs 200 and 210 of the mounting arrangement 180 may be adjusted as in the mounting arrangements 10 and 100. The platforms 184 and 186 also include apertures (not shown), which may be curved slots, for mounting a vibrator to the mounting base 182.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A vibrator mounting arrangement for securing a vibrator to an object to be vibrated including:

a mounting base adapted to receive the vibrator for attachment thereto;

a first foot member adapted to be secured to the object to be vibrated, said first foot member extending between a first end and a second end;

a first adjustment means for securing said first foot member to said mounting base and for providing selective pivotal movement of said first foot member about a first longitudinal axis with respect to said mounting base, said first foot member extending between said first end and said second end substantially parallel to said first longitudinal axis; and a second foot member adapted to be secured to said mounting base and adapted to be secured to the object to be vibrated;

whereby said first foot member is selectively pivotal about said first longitudinal axis to conform to the configuration of the surface of the object to be vibrated.

2. The vibrator mounting arrangement of claim 1 including a second adjustment means for securing said second foot member to said mounting base and for providing selective pivotal movement of said second foot member with respect to said mounting base.

3. The vibrator mounting arrangement of claim 2 wherein said first adjustment means includes a first curved flange adapted to selectively attach said first foot member to said mounting base at various different angular orientations as desired and said second adjustment means includes a second curved flange adapted to selectively attach said second foot member to said mounting base at various different angular orientations as desired.

4. The vibrator mounting arrangement of claim 3 wherein said first curved flange includes an elongate slot and said second curved flange includes an elongate slot, said slots providing selective movement of said first and second foot members with respect to said mounting base.

5. The vibrator mounting arrangement of claim 4 wherein said first curved flange is rigidly attached to said first foot member and selectively adjustably attached to said mounting base and second curved flange is rigidly attached to said second foot members and selectively adjustably attached to said mounting base.

6. The vibrator mounting arrangement of claim 5 wherein said mounting base includes a first lip and a second lip, said first curved flange being adjustably attached to said first lip and said second curved flange being adjustably attached to said second lip.

7. The vibrator mounting arrangement of claim 6 wherein said first lip is curved to conform to the curvature of said first curved flange and said second lip is curved to conform to the curvature of said second curved flange.

8. The vibrator mounting arrangement of claim 1 wherein said first adjustment means includes a first curved flange, said first curved flange adapted to selectively attach said first foot member to said mounting base at various different angular orientations as desired, said first curved flange being curved about said first longitudinal axis.

9. The vibrator mounting arrangement of claim 8 wherein said first curved flange includes an elongate slot, said slot providing selective pivotal movement of said first foot member with respect to said mounting base about said first longitudinal axis.

10. The vibrator mounting arrangement of claim 9 wherein said first curved flange is rigidly attached to said first foot member and selectively adjustably attached to said mounting base.

11. The vibrator mounting arrangement of claim 10 wherein said mounting base includes a first lip, said first curved flange being selectively adjustably attached to said first lip.

12. The vibrator mounting arrangement of claim 11 wherein said first lip is curved to conform to the curvature of said first curved flange.

13. The vibrator mounting arrangement of claim 8 wherein said first curved flange includes a plurality of elongate slots, said slots being substantially parallel to one another and adapted to provide selective pivotal movement of said first foot member with respect to said mounting base about said first longitudinal axis.

14. The vibrator mounting arrangement of claim 1 including adhesive means adapted to be disposed between said foot members and the object to be vibrated to removably and adhesively secure said vibrator mounting arrangement to the object to be vibrated.

15. A vibrator mounting arrangement for securing a vibrator to an object to be vibrated including:

a mounting base adapted to receive the vibrato r for attachment thereto;

a first foot member adapted to be secured to the object to be vibrated, said first foot member extending along a first longitudinal axis between a first end and a second end;

a first adjustment means for securing said first foot member to said mounting base and for providing selective movement of said first foot member with respect to said mounting base; and a second foot member adapted to be secured to said mounting base and adapted to be secured to the object to be vibrated, said second foot member extending along a second longitudinal axis between a first end and a second end, said first longitudinal axis being disposed at an angle to said second longitudinal axis;

whereby said first foot member is selectively positionable to conform to the configuration of the surface of the object to be vibrated.

16. The vibrator mounting arrangement of claim 15 including a second adjustment means for securing said second foot member to said mounting base and for providing selective pivotal movement of said second foot member with respect to said mounting base.

17. A vibrator mounting arrangement for securing a vibrator to an object to be vibrated including:

a mounting base adapted to receive the vibrator for attachment thereto, said mounting base including a first platform and a second platform attached to said first platform, said second platform being selectively positionable with respect to said first platform;

a first foot member adapted to be secured to the object to be vibrated;

a first adjustment means for securing said first foot member to said mounting base and for providing selective movement of said first foot member with respect to said mounting base; and a second foot member adapted to be secured to said mounting base and adapted to be secured to the object to be vibrated;

whereby said first foot member is selectively positionable to conform to the configuration of the surface of the object to be vibrated.

18. The vibrator mounting arrangement of claim 17 including a second adjustment means for securing said second foot member to said mounting base and for providing selective pivotal movement of said second foot member with respect to said mounting base.

* * * * *